US006543825B1

(12) United States Patent
Dragutin

(10) Patent No.: US 6,543,825 B1
(45) Date of Patent: Apr. 8, 2003

(54) BOTTLE HOLDER

(76) Inventor: Jazbec Dragutin, Josipa Gigle 7, 1000 Zagreb (HR)

( * ) Notice: Subject to any disclaimer, the term of this patent is extended or adjusted under 35 U.S.C. 154(b) by 0 days.

(21) Appl. No.: 09/958,779

(22) PCT Filed: Jun. 9, 2000

(86) PCT No.: PCT/HR00/00022

§ 371 (c)(1),
(2), (4) Date: Oct. 10, 2001

(87) PCT Pub. No.: WO01/62614

PCT Pub. Date: Aug. 30, 2001

(30) Foreign Application Priority Data

Feb. 15, 2000 (HR) ..... 20000086 A

(51) Int. Cl.[7] ..... B65D 23/10
(52) U.S. Cl. ..... 294/31.2; 294/33; 215/396
(58) Field of Search ..... 294/27.1, 31.2, 294/33; 215/396; 16/422, 425

(56) References Cited

U.S. PATENT DOCUMENTS

| | | | | | |
|---|---|---|---|---|---|
| 1,965,726 | A | * | 7/1934 | Smith, Jr. | 220/737 |
| 2,208,478 | A | * | 7/1940 | Simons et al. | 294/33 |
| 3,688,936 | A | * | 9/1972 | Killigrew, Jr. | 16/425 |
| 4,379,578 | A | | 4/1983 | Schuler | 294/31.2 |
| 4,627,546 | A | | 12/1986 | Carranza | 215/100 A |
| 4,667,359 | A | | 5/1987 | Polotti | 7/151 |
| 4,773,549 | A | | 9/1988 | Avraham | 215/100 A |
| 4,982,868 | A | * | 1/1991 | Robbins, III | 215/395 |
| 5,183,169 | A | * | 2/1993 | Grzych | 215/395 |
| 5,897,150 | A | | 4/1999 | Rubini | 294/27.1 |
| 6,003,205 | A | | 12/1999 | Dehaven | 16/425 |

FOREIGN PATENT DOCUMENTS

| | | | | |
|---|---|---|---|---|
| EP | 524328 A1 | | 1/1993 | |
| WO | 83/00852 | * | 3/1983 | 294/31.2 |

* cited by examiner

*Primary Examiner*—Dean J. Kramer
(74) *Attorney, Agent, or Firm*—St. Onge Steward Johnston & Reens, LLC

(57) ABSTRACT

The bottle holder is designed for a PET bottle that is awkward to incline in order to pour its content (non-alcoholic beverages or mineral water) because the bottle lies awkwardly in one's hand(s). The top part of the holder is fastened to the bottleneck, and the lower part clasps the bottle at approximately two thirds to one half of the bottle's height. The fastening part features a device that prevents the bottle's axial movement prior to a radial movement of the holder in relation to the bottle.

19 Claims, 2 Drawing Sheets

BOTTLE HOLDER

DESCRIPTION

The problem with PET bottles, normally used for non-alcoholic beverages and mineral water, occurs when you try to pour the liquid they contain, particularly in 1–1 i.e. 2–1 bottles, because the bottle lies awkwardly in your hand. This is particularly annoying when you first pour liquid from the bottle, because with a minimum bottle inclination there is a sudden burst of liquid while the bottle is the heaviest. Besides this, the bottle tends to slip because it gets bedewed when cooled. PET bottles are typically manufactured by blowing and have very smooth walls. Bedewing makes a rather heavy bottle very slippery. The problem could be solved by a different bottle design with recesses and protrusions, which means more complicated manufacturing and consequently more expensive bottle. Besides, bottles with concave or convex surfaces are usually form-protected and cannot be manufactured without the approval of the form owner.

In order to avoid the above shortcomings, a bottle holder can be fitted to the bottle in that it is fastened to the bottleneck and clasps the bottle at approximately two thirds to one half of its height. By taking the holder's grip, the bottle can be easily lifted and inclined without direct contact with the bottle, and it can be carried and poured from safely.

Figure 1:
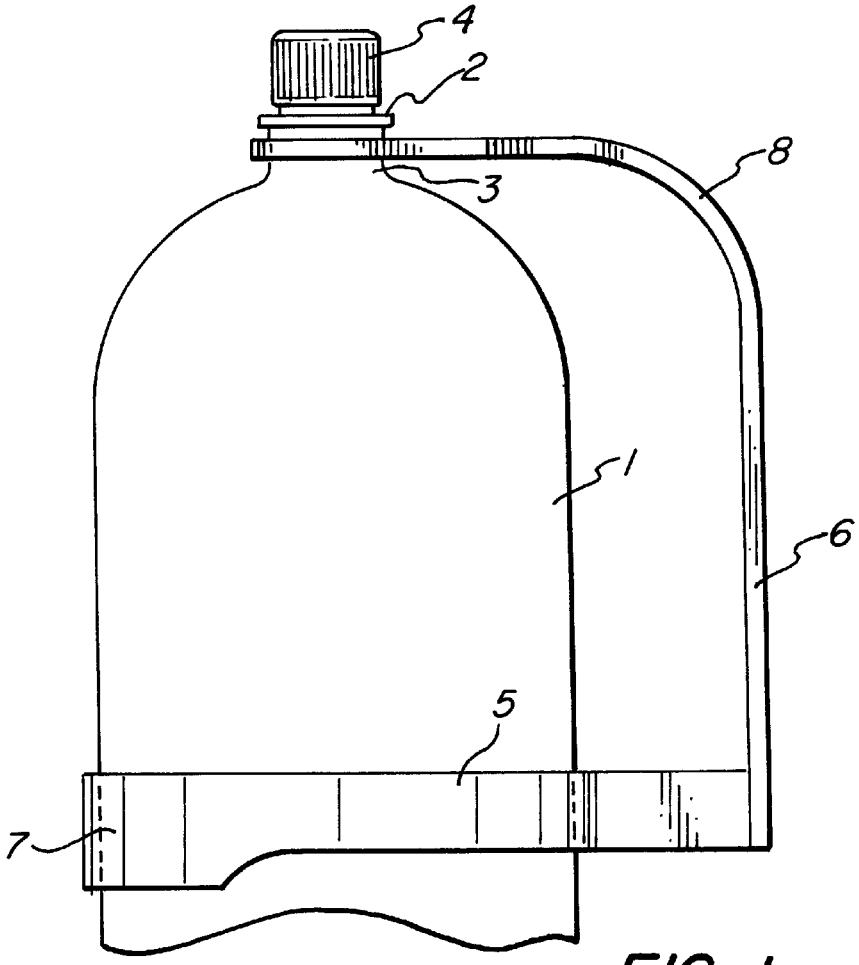

The drawings of the bottle holder show:

FIG. 1 Bottle holder fitted on a bottle

Figure 2:
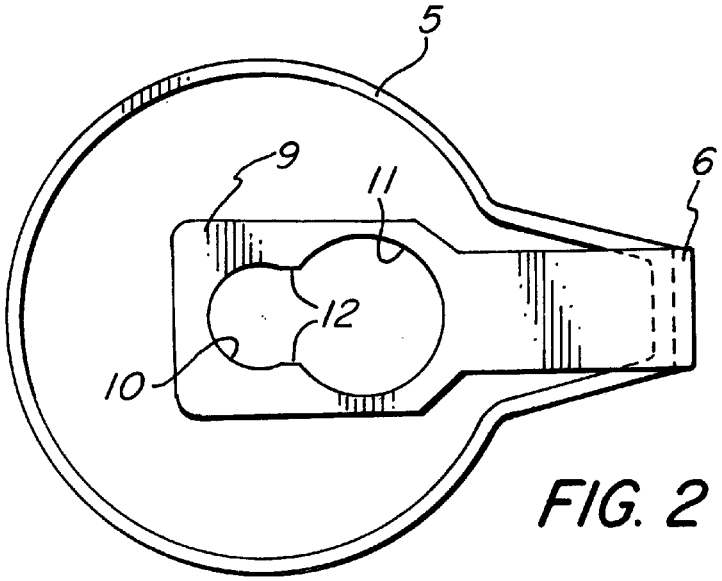

FIG. 2 Bottle holder top view, without bottle

FIG. 3 clamp

Figure 4:
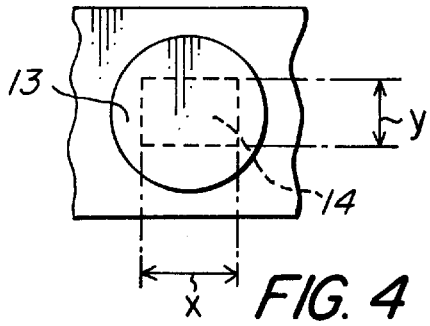

FIG. 4 button and rectangular detail/part of clamp/

Figure 5:
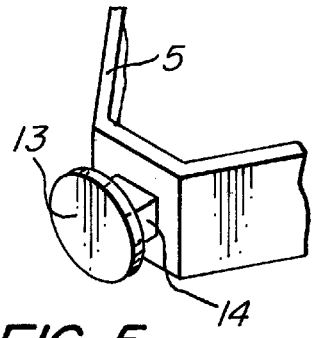

FIG. 5 axonometric button and rectangular detail/part of clamp/

Figure 6:
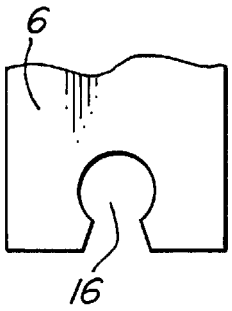

FIG. 6 grip opening

Figure 7:
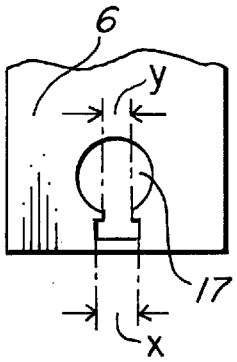

FIG. 7 grip opening

Figure 8:
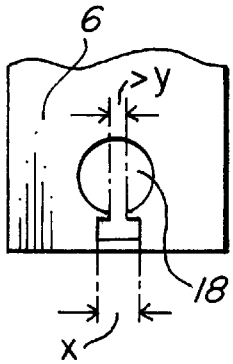

FIG. 8 grip opening

Top part of a normal bottle (1) ends with transition to bottleneck, so that below the ring (2) there is a narrow part of the bottleneck (3). Above the ring (2) begins the part with thread and cap (4) designed to meet the technological and structure requirements.

The bottle holder consists of a clamp (5) clasping the bottle (1) at two thirds to one half from the bottom. The clamp (5) is slightly larger than the diameter of the bottle (1), and is made of a flat strip. Approximately one fourth to one third of the length of the clamp (5) opposite from the grip (6) features reinforcement (7) on the upper or lower side of the clamp. The reinforcement (7) serves to enlarge the bottle supporting surface (5). On the outside, the reinforcement (7) may carry a commercial or a label of the bottling company. On the opposite side from the reinforcement (7), the clamp ceases to follow the form of the bottle (1) and reaches the grip (6) so that the grip (6) is at such distance from the bottle (1) as to enable fingers to pass through between the grip (6) and the bottle (1). The grip (6) and the clamp (5) can be connected either separably or inseparably. If inseparable, there may be the possibility of turning the grip (6) around in relation to the clamp (5). This can be practical for the transport of bottle holders from the manufacturer to their actual fitting on a bottle.

The grip (6) is flat, with a possibility of slight rounding to better lie in a hand, and reaches up to an arch (8), which can be round, to a broadening (9). The broadening (9) is vertical to the line of symmetry of the bottle (1). The broadening features an opening (10) of the size of the bottleneck (3), so that it tightly fits around it. On the opposite side from the grip (6), the opening (10) is round and on the other side it turns into an even larger opening (11) of the size slightly larger than the ring (2), so that it can easily slip over it axially. Opening (10) and opening (11) are connected by a gauge (12) with such width that it only allows for a passage of the bottleneck (3) from opening (11) to opening (10) after overcoming some resistance. In taking the bottle holder off a bottle (1), it is again necessary to overcome this resistance when the bottleneck (3) passes over the gauge (12) in inclining a bottle to pour its content, the bottleneck (3) is in opening (10) and does not pass through the gauge (12) into opening (11).

The clamp can also be ellipsoidal. The ellipsoidal form of the clamp would provide more contact surface, which would provide for a better grip on the bottle and receiving bottles of differing diameter.

Figure 3:
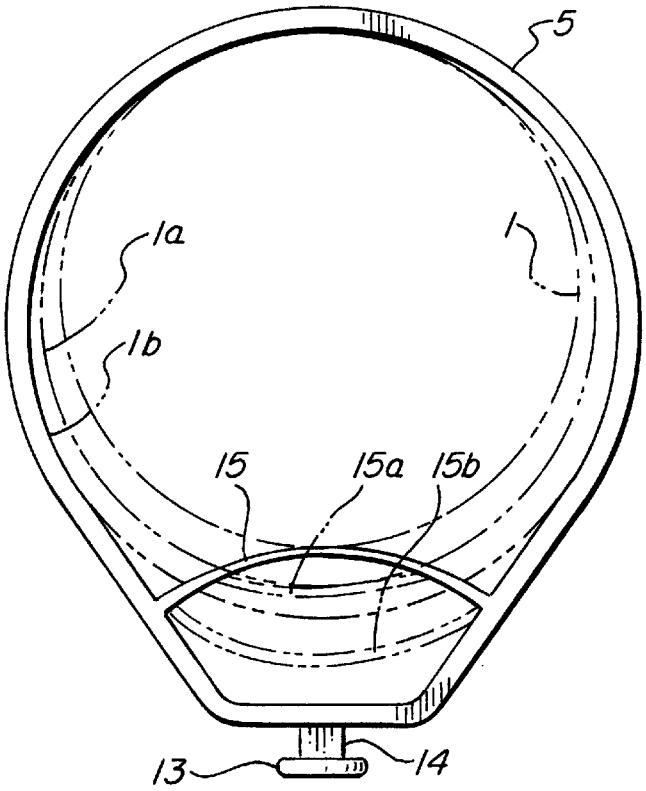

The clamp can also be made with an elastic rounded plate (15) shown in FIG. 3, located on the inside of the clamp and directed towards the reinforcement (7). The rounded form and the elasticity of the plate (15) provides for receiving bottles of differing diameters and better grip on the bottle.

For a separable and inseparable connection between the clamp (5) and the grip (6) there is a protrusion on the clamp, as well as the cutout section or the hole on the grip. The clamp (6) protrusion is on the rectangular part. The protrusion consists of the neck (14) and the button (13). The neck (14) may be in the form of a cylinder or rectangular (right parallelepiped), while the button (13) is in the form of a cylinder. It is important to note that the diameter of the button must be larger than the diagonal of the rectangular parallelepiped base or the diameter of the cylinder (depending on the version of the neck (14). The grip, as shown in FIG. 6, features separable connection with the clamp that has a protrusion in the cylinder-cylinder form. The grip in FIG. 6 has a cut-out section (16) in the lower part, and it is defined by the form that changes from lozenge to circle, and the diameter of the round part is smaller than the diameter of the button (13). By applying hand force, the grip is pressed onto the cylindrical neck of the clamp protrusion.

The grip shown in FIG. 7 has a hole (17) on the lower part that with its form provides a separable connection between the grip (6) and the clamp (5), being defined by a rectangular lower section with its width ("x") equalling the width ("x") of the rectangular (14), the upper section in the form of a circle with its diameter larger than the diameter of the button (13), and the round and rectangular part being connected by a neck whose width ("y") equals the height ("y") of the neck rectangular (14). Equal value of the width and height provide for the separability of the clamp (5) and the grip (6). The grip in FIG. 8 has a hole (18) that with its form provides an inseparable connection between the grip (6) and the clamp (5), being defined by a rectangular lower section with its width ("x") equalling the width ("x") of the rectangular (14), the upper section in the form of a circle with its diameter larger than the diameter of the button (13), and the lozenge narrowing between the round and rectangular par whose width ("y") is smaller than the height ("y") of the neck rectangular (14). Smaller width than height requires the application of hand force to assemble and provides inseparable connection between the clamp (5) and the grip (6).

The size of the clamp (5) in relation to the bottle (1) is such as to make it possible to turn the clamp (5) and grip (6)

with the broadening (9) around from the position of the bottleneck (3) in opening (11) to opening (10) and vice versa.

What is claimed is:

1. A plastic bottle holder, comprising:

an ellipsoidal clamp, said ellipsoidal clamp formed of a horizontal strip defining an aperture sized to receive a plastic bottle, said strip being curved to form a partial circular section, said strip having two generally flat sections extending from said partial circular portion and connecting together at a connection section, said connection section being located oppositely from said partial circular section at a distance to provide a clearance between a plastic bottle fitted in said aperture and said connection section;

a grip having a lower end and an upper end, said lower end being a vertically extending strip rotatably mounted on said connection section of said ellipsoidal clamp, said upper end extending horizontally from said lower end parallel to said partial circular portion of said clamp, said upper end having an opening sized to receive a bottleneck, and said grip having a clearance from a bottle positioned in said ellipsoidal clamp.

2. A bottle holder in accordance with claim 1 wherein said vertically extending strip of said grip is sized to be grasped by a user's hand.

3. A bottle holder in accordance with claim 2 wherein said opening in said upper end of said grip is positioned to be axially aligned with said bottleneck.

4. A bottle holder in accordance with claim 3 wherein said opening is keyhole shaped with a smaller diameter portion of said keyhole shaped opening being axially aligned with said bottleneck.

5. A bottle holder in accordance with claim 4 wherein said keyhole shaped opening has a larger diameter portion, and a gauge is provided between the larger diameter portion and the smaller diameter portion to provide frictional resistance against said bottleneck.

6. A bottle holder in accordance with claim 1 wherein said connection section of said ellipsoidal clamp has an outwardly extending neck and button, and said grip has a closed keyhole aperture in its lower end, and said grip is rotatably mounted on said ellipsoidal clamp by mounting said keyhole aperture on said neck and button.

7. A bottle holder in accordance with claim 1 wherein said connection section of said ellipsoidal clamp has an outwardly extending neck and button, and said grip has an open ended keyhole aperture in its lower end, and said grip is rotatably mounted on said ellipsoidal clamp by mounting said keyhole aperture on said neck and button.

8. A bottle holder in accordance with claim 1 wherein at least a portion of said partial circular section of said ellipsoidal clamp has a reinforcement provided by having a greater width than other portions of said ellipsoidal clamp.

9. A bottle holder in accordance with claim 8 wherein an advertisement or a label is provided on an outer surface of said reinforcement.

10. A plastic bottle holder, comprising:

an ellipsoidal clamp, said ellipsoidal clamp formed of a horizontal strip defining an aperture sized to receive a plastic bottle, said strip being curved to form a partial circular section, said strip having two generally flat sections extending from said partial circular portion and connecting together at a connection section, said connection section having an outwardly extending neck and button, said connection section being located oppositely from said partial circular section at a distance to provide a clearance between a plastic bottle fitted in said aperture and said connection section;

a grip having a lower end and an upper end, said lower end being a vertically extending strip rotatably mounted on said connection section of said ellipsoidal clamp, said vertically extending strip of said grip is sized to be grasped by a user's hand, said upper end extending from said low end parallel to said partial circular portion of said ellipsoidal clamp, said upper end having a keyhole shaped opening having a larger diameter section and a smaller diameter section, said keyhole shaped opening being sized to receive a bottleneck, said smaller diameter section of said keyhole shaped opening being positioned to be axially aligned with a said bottleneck, said grip lower end having a keyhole aperture, said grip being rotatably mounted to said ellipsoidal clamp by mounting said keyhole aperture on said neck and button; and said grip having a clearance from a bottle positioned in said ellipsoidal clamp.

11. A bottle holder in accordance with claim 10 wherein said keyhole aperture of said grip is an open-ended keyhole aperture.

12. A bottle holder in accordance with claim 10 wherein said keyhole aperture of said grip is a closed keyhole aperture.

13. A bottle holder in accordance with claim 10 wherein at least a portion of said partial circular section of said ellipsoidal clamp has a reinforcement provided by having a greater width than other portions of said ellipsoidal clamp.

14. A bottle holder in accordance with claim 13 wherein an advertisement or a label is provided on an outer surface of said reinforcement.

15. The combination of a plastic bottle holder and a plastic bottle, comprising:

an ellipsoidal clamp, said ellipsoidal clamp formed of a horizontal strip defining an aperture sized to receive a plastic bottle, said strip being curved to form a partial circular section, said strip having two generally flat sections extending from said partial circular portion and connecting together at a connection section, said connection section having an outwardly extending neck and button, said connection section being located oppositely from said partial circular section at a distance to provide a clearance between a plastic bottle fitted in said aperture and said connection section;

a plastic bottle having a bottleneck fitted in said aperture;

a grip having a lower end and an upper end, said lower end being a vertically extending strip rotatably mounted on said connection section of said ellipsoidal clamp, said vertically extending strip of said grip is sized to be grasped by a user's hand, said upper end extending from said lower end parallel to said partial circular portion of said ellipsoidal clamp, said upper end having a keyhole shaped opening having a larger diameter section and a smaller diameter section, said bottleneck being received in said keyhole shaped opening with said smaller diameter section of said keyhole shaped opening axially aligned with a said bottleneck, said grip lower end having a keyhole aperture, said grip being rotatably mounted to said ellipsoidal clamp by mounting said keyhole aperture on said neck and button; and said grip having a clearance from said plastic bottle positioned in said clamp.

16. The combination of a plastic bottle holder and a plastic bottle in accordance with claim 15 wherein said keyhole aperture of said grip is an open-ended keyhole aperture.

17. The combination of a plastic bottle holder and a plastic bottle in accordance with claim 15 wherein said keyhole aperture of said grip is a closed keyhole aperture.

18. The combination of a plastic bottle holder and a plastic bottle in accordance with claim 15 wherein at least a portion of said partial circular section of said clamp has a reinforcement provided by having a greater width than other portions of said clamp.

19. The combination of a plastic bottle holder and a plastic bottle in accordance with claim 18 wherein an advertisement or a label is provided on an outer surface of said reinforcement.

* * * * *